US010753370B2

(12) United States Patent
Hall et al.

(10) Patent No.: US 10,753,370 B2
(45) Date of Patent: Aug. 25, 2020

(54) VARIABLE DIFFUSER WITH AXIALLY TRANSLATING END WALL FOR A CENTRIFUGAL COMPRESSOR

(71) Applicant: Rolls-Royce Corporation, Indianapolis, IN (US)

(72) Inventors: Christopher Hall, Indianapolis, IN (US); David Sayre, Greenwood, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 426 days.

(21) Appl. No.: 15/602,643

(22) Filed: May 23, 2017

(65) Prior Publication Data

US 2018/0340549 A1 Nov. 29, 2018

(51) Int. Cl.

| | |
|---|---|
| ***F04D 29/46*** | (2006.01) |
| ***F04D 27/00*** | (2006.01) |
| ***F04D 29/08*** | (2006.01) |
| ***F04D 29/28*** | (2006.01) |
| ***F04D 29/42*** | (2006.01) |
| ***F04C 27/00*** | (2006.01) |

(52) U.S. Cl.

CPC ..... *F04D 29/462* (2013.01); *F04C 27/002* (2013.01); *F04D 29/083* (2013.01); *F04D 29/284* (2013.01); *F04D 29/4206* (2013.01); *F04D 29/464* (2013.01); *F05D 2250/52* (2013.01); *F05D 2260/56* (2013.01); *F05D 2260/57* (2013.01)

(58) Field of Classification Search

CPC .... F04D 29/462; F04D 29/464; F04D 29/466; F04D 29/468; F04D 29/46

USPC ..... 415/191

See application file for complete search history.

(56) References Cited

U.S. PATENT DOCUMENTS

| | | | | |
|---|---|---|---|---|
| 2,996,996 | A * | 8/1961 | Jassniker | F01D 17/143 415/126 |
| 3,799,694 | A | 3/1974 | Duzan | |
| 3,992,128 | A | 11/1976 | Lunsford et al. | |
| 4,718,819 | A * | 1/1988 | Rogo | F04D 29/462 415/149.1 |
| 5,207,559 | A | 5/1993 | Clevenger et al. | |
| 8,147,186 | B2 | 4/2012 | Ibaraki et al. | |

FOREIGN PATENT DOCUMENTS

| | | |
|---|---|---|
| EP | 0058533 B1 | 7/1985 |
| EP | 2626573 A1 | 8/2013 |

OTHER PUBLICATIONS

European Patent Office, Extended European Search Report for corresponding EP Application No. 18168743.5 dated Oct. 9, 2018, 8pgs.

* cited by examiner

*Primary Examiner* — Moshe Wilensky
*Assistant Examiner* — Jason Mikus
(74) *Attorney, Agent, or Firm* — Barnes & Thornburg LLP

(57) ABSTRACT

A variable diffuser for a centrifugal compressor comprises a passage between opposing disc faces and a plurality of vanes extending therethrough with a fixed angle relative to the engine centerline. Axial displacement between the opposing disc faces is variable. The vanes extend through one of the opposing disc faces as that disc face is axially translated.

12 Claims, 6 Drawing Sheets

VARIABLE DIFFUSER WITH AXIALLY TRANSLATING END WALL FOR A CENTRIFUGAL COMPRESSOR

FIELD OF THE DISCLOSURE

The present disclosure relates generally to centrifugal compressors, and more specifically to a variable-geometry diffuser having an axially-translating end wall for use with a centrifugal compressor.

BACKGROUND

Centrifugal compressors are commonly used for fluid compression in rotating machines such as, for example, a gas turbine engine. Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

A centrifugal compressor is a device in which a rotating rotor or impeller delivers air at relatively high velocity by the effect of centrifugal force on the gas within the impeller. Such a compressor also includes a diffuser, which normally is an annular space surrounding the periphery of the impeller and which usually is provided with vanes to guide the gas flow in order to recover static pressure, and minimize turbulence and frictional losses in the diffuser. The air or other gas (which will be referred to hereafter as air) is delivered from the impeller with a substantial radial component of velocity and ordinarily a substantially greater tangential component. The function of the diffuser is to decelerate the air smoothly and to recover as static pressure (head) the total or stagnation pressure (dynamic head) of the air due to its velocity.

While centrifugal compressors operate over a variety of flow conditions and ranges, they are designed to operate most efficiently at one set of operating conditions, usually referred to as the design point. For example, a centrifugal compressor may be designed for maximum efficiency and minimum adequate surge margin when operating to supply maximum shaft horsepower. As a consequence of selecting these design conditions, when the compressor is operating off the design point, it operates at reduced efficiency and potentially reduced stall margin. It is therefore desirable to improve the compressor's efficiency off the design point and low flow stall margin. One option for improving efficiency and/or stall margin can be to vary the diffuser area as the operating point of the compressor changes.

BRIEF DESCRIPTION OF THE DRAWINGS

The following will be apparent from elements of the figures, which are provided for illustrative purposes and are not necessarily to scale.

Figure 1:
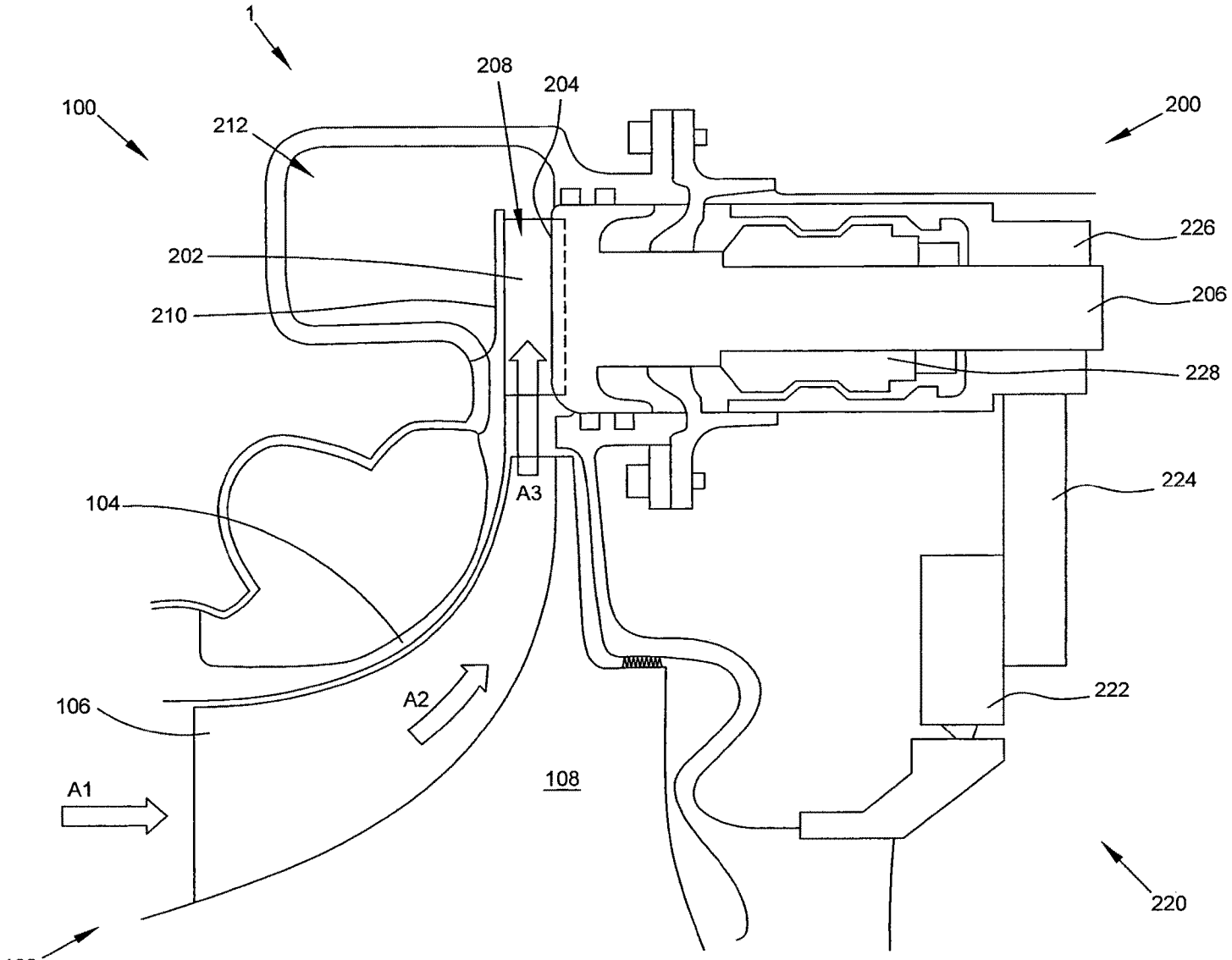
FIG. 1 is a schematic and cross-sectional view of a centrifugal compressor having a centrifugal compressor assembly and a diffuser assembly in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

During low flow operations, the stall margin for a typical centrifugal compressor can become unacceptably low. Inlet guide vanes have been used to successfully treat this problem, but inlet guide vanes are an inefficient way to improve stall margin in low flow conditions. It is therefore desirable to improve stall margin across all operating conditions, including low flow, through the development of an improved diffuser assembly for use with a centrifugal compressor.

The present disclosure is directed to a diffuser assembly that overcomes the above-discussed deficiencies of prior art centrifugal compressor diffusers. More specifically, the present disclosure is directed to a diffuser assembly for use with a centrifugal compressor that improves compressor efficiency and maintains adequate stall margins across a wide range of operating conditions. The disclosed diffuser assembly allows for the variation and possible optimization of diffuser geometry for operating conditions that deviate from the design point of the compressor.

FIG. 1 is a schematic and sectional view of a centrifugal compressor 1 comprising a centrifugal compressor assembly 100 coupled with a variable-geometry diffuser assembly 200 in accordance with some embodiments of the present disclosure. Centrifugal compressor assembly 100 comprises a rotatable impeller 102 encased within an annular shroud 104. Impeller 102 comprises a plurality of blades 106 extending from a central rotor 108 or hub. For illustrative purposes, one of the blades 106 is illustrated in FIG. 1.

Annular shroud 104 at least substantially encases and is positioned radially outward from impeller 102. Annular shroud 104 may be a static structure, or may be dynamic to provide dynamic control of the clearance between the shroud 104 and blade 106. Dynamic shrouds 104 may be capable of deflecting toward and away from blade 106, or may be moveable in an axial and/or radial direction. For example, systems and methods of dynamic clearance control are disclosed in commonly-owned U.S. patent application Ser. Nos. 15/165,468; 15/165,404; 15/165,728; 15/165,555; and 15/234,601, the entirety of which are hereby incorporated by reference.

Air flow through the centrifugal compressor is illustrated by progressing Arrows A1, A2, and A3. Air enters the centrifugal compressor assembly 100 at Arrow A1 at an inlet pressure, and flows across the blades 106 at Arrow A2 before exiting the assembly 100 at Arrow A3 at a discharge pressure that is higher than the inlet pressure.

Air discharged from the centrifugal compressor assembly 100 is directed to diffuser assembly 200. As discussed above, diffusers are known in the art to smoothly decelerate air discharged from the assembly 100 and recover as static head the dynamic head of the air. The disclosed diffuser assembly 200 comprises a plurality of diffuser vanes 202 and an end wall 204 coupled to one or more cam shafts 206. As explained below, end wall 204 is configured to translate in an axially forward and aft direction to effect variation in the geometry and area of the diffuser passage 208, which may also be referred to as a flow path. In some embodiments, three or more cam shafts 206 are spaced about the circumference of end wall 204 and serve as a diving mechanism for the axial translation of the end wall 204.

Figure 2A:
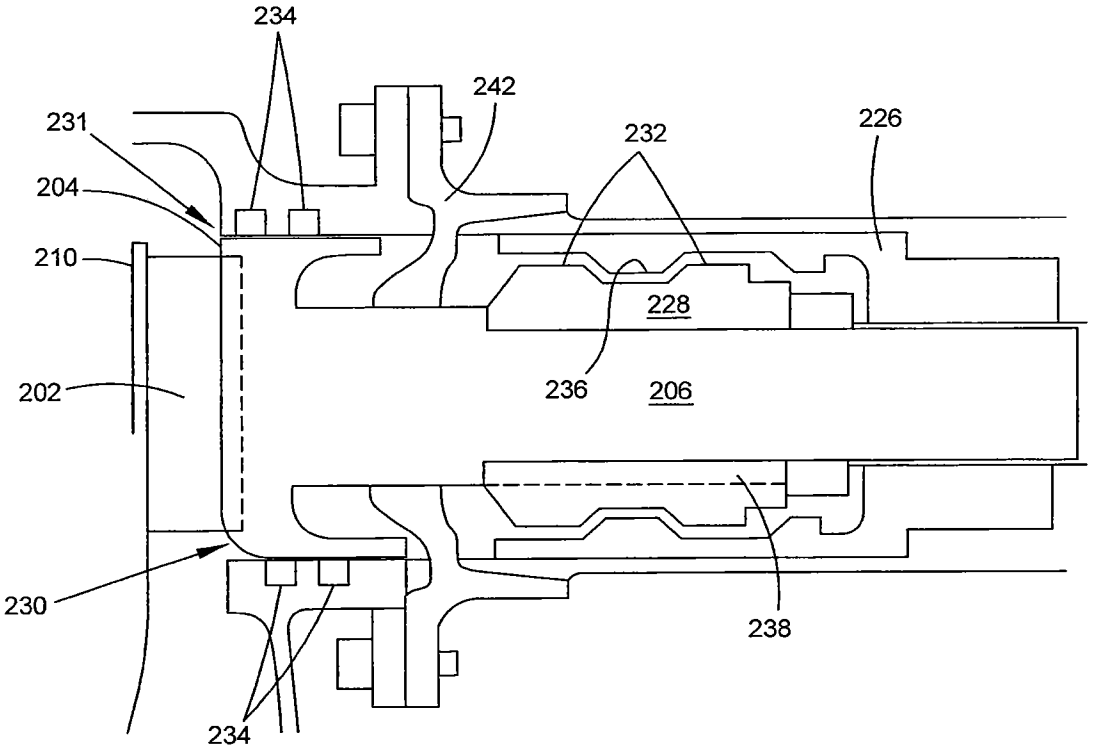
FIG. 2A is a partial schematic and cross-sectional view of a diffuser assembly with an end wall in an axially aft position in accordance with some embodiments of the present disclosure.
Figure 2B:
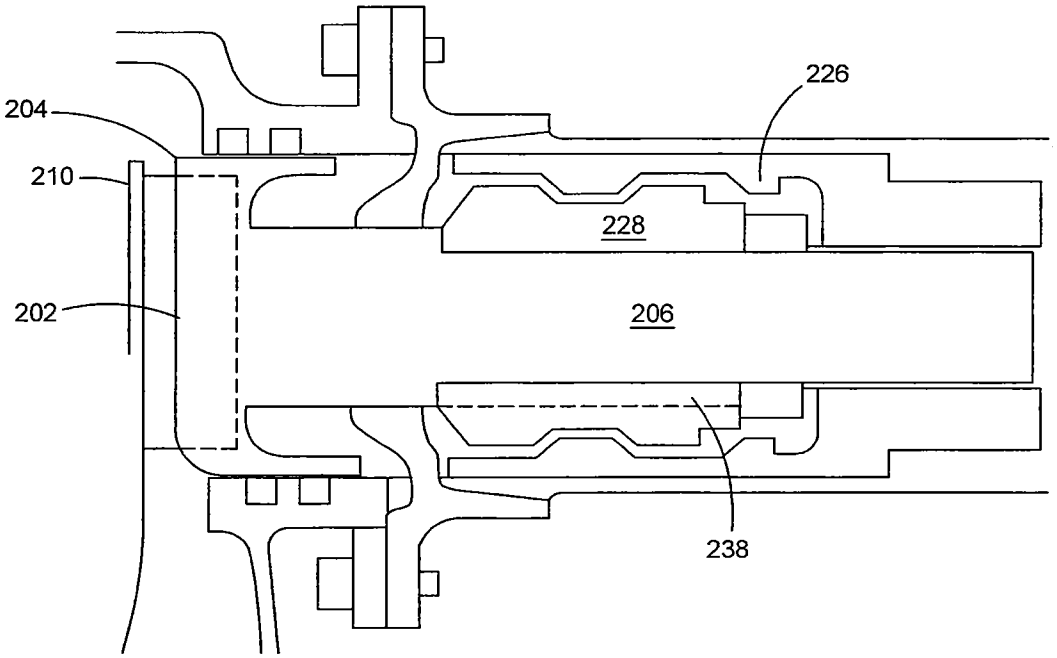
FIG. 2B is a partial schematic and cross-sectional view of a diffuser assembly with an end wall in an axially forward position in accordance with some embodiments of the present disclosure.

FIGS. 2A and 2B are schematic and sectional views of a diffuser assembly 200 in accordance with some embodiments of the present disclosure. FIG. 2A illustrates a diffuser assembly 200 having an end wall 204 in an axially aft position, while FIG. 2B illustrates a diffuser assembly 200 having an end wall 204 in an axially forward position. FIG. 2B is thus shows the diffuser assembly 200 configured for low flow operations. The axially aft position may be referred to as a first position and the axially forward position may be referred to as a second position. The end wall 204 may be continuously variable between the first and second positions.

Diffuser passage 208 is a generally annular space defined between end wall 204 (or back wall) and a front wall 210 that is coupled to or integrally formed with shroud 104. End wall 204 and front wall 210 form opposing disc faces that each extend from a radially inner edge to a radially outer edge. The disc faces may be co-axial and parallel. Diffuser passage 208 is defined as the axial displacement between the opposing disc faces. Diffuser passage 208 additionally extends between the outlet of the impeller 102 and a scroll 212 that receives air that has passed through the diffuser assembly 200. In other words, passage 208 has an inlet 250 proximate the radially inner edge of the disc face and an outlet 252 proximate the radially outer edge of the disc face. Air flows from the high pressure outlet of the centrifugal compressor assembly 100 through the diffuser passage 208 and into scroll 212.

The plurality of vanes 202 extend across diffuser passage 208 and assist with the smooth deceleration of the air exiting the centrifugal compressor assembly 100. Each of the plurality of vanes 202 span at least between end wall 204 and front wall 210. Each of the plurality of vanes 202 is translationally fixed to one of end wall 204 or front wall 210. Further, each of the plurality of vanes 202 have a fixed angle with respect to the engine centerline. Vanes 202 may be constant or variable chord vanes, and all vanes 202 may be oriented at the same angle or individual or groups of vanes 202 may be oriented at different angles. The angle of one or more vanes 202 may be adjusted outside of engine operation.

In some embodiments, the plurality of vanes 202 are each rigidly coupled to front wall 210 and extend axially aft to end wall 204. In some embodiments, vanes 202 extend into the end wall 204 even when the end wall 204 is translated to its axially aftmost position.

Scroll 212 serves as a reservoir of high pressure discharge air from the centrifugal compressor assembly 100. Although the illustrated embodiment of the centrifugal compressor 1 discloses a scroll 212, the present disclosure is not limited to scroll-type exit systems. Additional exit systems may be used with the presently-disclosed diffuser assembly 200.

End wall 204 is translated in an axially forward or aft direction based on motion of an actuator. An actuator may be disposed aft of and coupled to end wall 204 or, in embodiments with a moveable front wall 210 may be disposed forward of front wall 210.

In some embodiments such as that illustrated in FIGS. 2A and 2B, actuator is an actuator assembly 220 comprising a unison ring 222, crank arm 224, outer cam portion 226, inner cam portion 228 also referred to as the cam drive, and the aforementioned cam shaft 206. Inner cam portion 228 and outer cam portion 226 may be collectively referred to as a cam mechanism. Cam shaft 206 may be referred to as a piston. In some embodiments, one or more of these actuator assembly components may be omitted or integrally formed with another component.

In other embodiments, other actuators may be used to adjust the position of end wall 204 or front wall 210, including but not limited to: pneumatic, thermal, electric, pressure, gear, and hydraulic actuators. Pneumatic actuators may receive fluid from an intermediate or high pressure source, such as an intermediate stage of the compressor of the gas turbine engine. Further, a single actuator may be provided or multiple actuators may be provided. In embodiments with multiple actuators, the actuators may be ganged together or may operate independently. The actuator may be configured to either "push" or "pull" on one of end wall 204 and front wall 210 to adjust the position of that wall relative to the other wall. The illustrated actuator assembly 220 is merely provided as an example of one type of actuator that may be used with the present disclosure of a diffuser assembly 200.

In the illustrated embodiment, three or more cam shafts 206 are spaced about the circumference of end wall 204. End wall 204 may be an annular member extending a full 360 degrees about the impeller 102, or may be segmented portions that are joined together to form a full annular end wall 204. End wall 204 may be coupled to cam shaft 206 such that axial translation of cam shaft 206 results in axial translation of end wall 204. Cam shafts 206 may vary in number or location to optimize deflection of end wall 204.

Cam shaft 206 is coupled to cam drive 228. Cam drive 228 comprises a plurality of ridges or threads 232 that are adapted to engage with corresponding ridges or threads 236 of an outer cam portion 226. Threads 232 of the cam drive 228 may thus be referred to as driven threads while threads 236 of outer cam portion 226 may be referred to as driving threads. Inner cam portion 228 may also be referred to as an inner sleeve which is rotationally fixed. Outer cam portion 226 may also be referred to as an outer sleeve which is translationally fixed. The outer cam portion 226 is rotationally driven by crank arm 224, and the inner cam portion 228 and cam shaft 206 are translationally drive by the outer cam portion 226.

Outer cam portion 226 may form an annular member around cam shaft 206. Outer cam portion 226 may be coupled to crank arm 224, which in turn may be coupled to unison ring 222. Unison ring 222 coordinates motion of each cam shaft 206 to ensure consistent circumferential positioning of the end wall 204. Unison ring 222 may be further coupled to an actuator (not shown).

Figure 7:
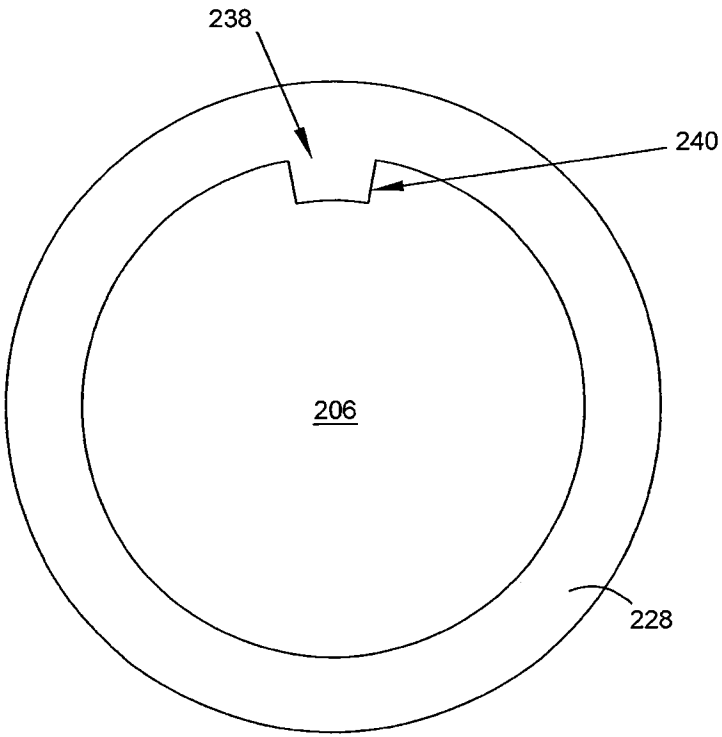
FIG. 7 is a profile cross-sectional view of an anti-rotation key and keyway engagement between a cam drive and cam shaft in accordance with some embodiments of the present disclosure.

In some embodiments one or more anti-rotation keys 238 are formed integrally with or coupled to cam drive 228. A corresponding key way 240 is formed as an axially extending groove in cam shaft 206. FIG. 7 provides a profile view of the engagement of a key 238 with a keyway 240. In some embodiments more than one key-keyway pair may be utilized for each cam shaft 206 and cam drive 228 pairing. Engagement of key 238 with keyway 240 prevent rotation of cam drive 228 relative to cam shaft 206. The effect of this engagement is the axial translation of cam shaft 206 and end wall 204 without rotational motion.

One or more piston seals 234 may be used to seal between cam shaft 206 and adjacent structures. Piston seals 234 prevent leakage from the diffuser passage 208 and scroll 212 to areas axially aft of end wall 204 and cam shaft 206. Piston seals 234 may be configured to circumferentially surround a forward portion of cam shaft 206.

In some embodiments one or more guide members 242 may extend from a casing or mounting bracket to engage cam shaft 206. Guide members 242 may be used to ensure proper positioning of cam shaft 206, and to guide the axial motion of the cam shaft 206.

In some embodiments end wall 204 may form a curvilinear diffuser lead-in 230 proximate the outlet of the centrifugal compressor assembly 100. Lead-in 230 may take many forms such as circular, curved, elliptical or spline. Various shapes of lead-in 230 would be selected for robustness and/or to optimize the diffuser assembly 200 for particular design points.

Similarly, the lead-out 231 is the transition between the diffuser passage 208 and the scroll 212. The lead-out 231 may take many forms such as circular, curved, elliptical or spline. Various shapes of lead-out 231 would be selected for robustness and/or to optimize the diffuser assembly 200 for a particular design point. Design considerations for the shape of lead-out 231 would include scroll height to diffuser and packaging limitations.

Figure 3:
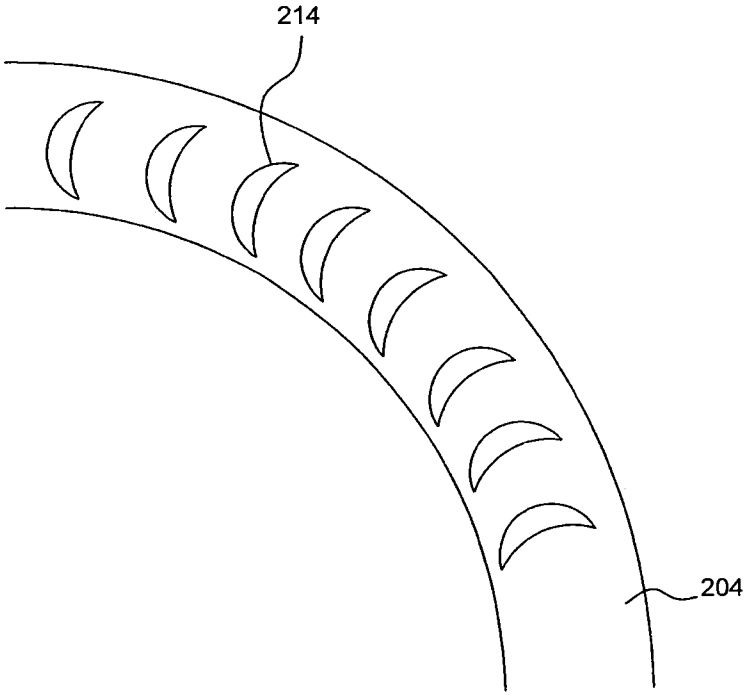
FIG. 3 is a profile view of an end wall having a plurality of vane slots in accordance with some embodiments of the present disclosure.

In various embodiments, the plurality of vanes 202 may extend axially aft from front wall 210, or may extend axially forward from end wall 204. In embodiments having the plurality of vanes 202 extending axially aft from front wall 210, end wall 204 comprises a plurality of vane slots 214, with each vane slot 214 to correspond with one of the plurality of vanes 202. Such an embodiment of the end wall 204 is illustrated in FIG. 3, which is a partial axial view of end wall 204.

Figure 5:
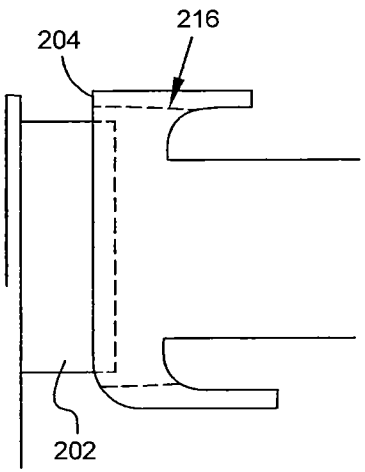
FIG. 5 is a detailed, partial schematic and cross-sectional view of a cam shaft having an open vane slot in accordance with some embodiments of the present disclosure.

In some embodiments each of the plurality of vane slots 214 may be in fluid communication with downstream or aft-located components. FIG. 5 is a schematic and sectional view of an embodiment wherein end wall 204 comprises a plurality of open vane slots 216. Open communication through a vane slot 216 would allow for air traversing the diffuser passage 208 to exit via a vane slot 216, thereby preventing recirculation of higher pressure diffuser exit air to the lower pressure inlet and thus improving efficiency of the centrifugal compressor.

Figure 6:
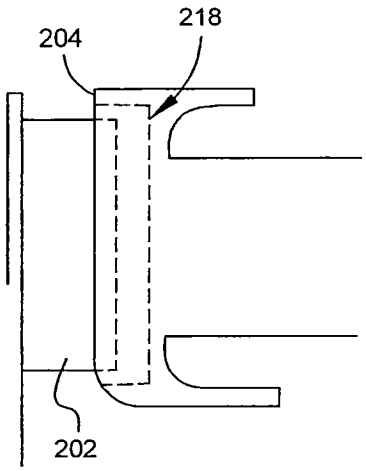
FIG. 6 is a detailed, partial schematic and cross-sectional view of a cam shaft having a pocketed vane slot in accordance with some embodiments of the present disclosure.

In other embodiments each of the plurality of vane slots 214 are formed as a closed pocket and are therefore not in fluid communication with other regions of the turbine engine. FIG. 6 is a schematic and sectional view of an embodiment wherein end wall 204 comprises a plurality of pocketed vane slots 218. Pocketed vane slots 218 prevent leakage from the diffuser passage 208. Each pocketed vane slot 218 must be dimensioned axially deep enough to ensure clearance between the pocketed vane slot 218 and the vane 202 when end wall 204 is in an axially forward most position. In embodiments comprising pocketed vane slots 218, each of the plurality of vane slots 218 envelopes a portion of a respective vane 202 that extends through the disc face in which the vane slots 218 are formed.

Figure 4:
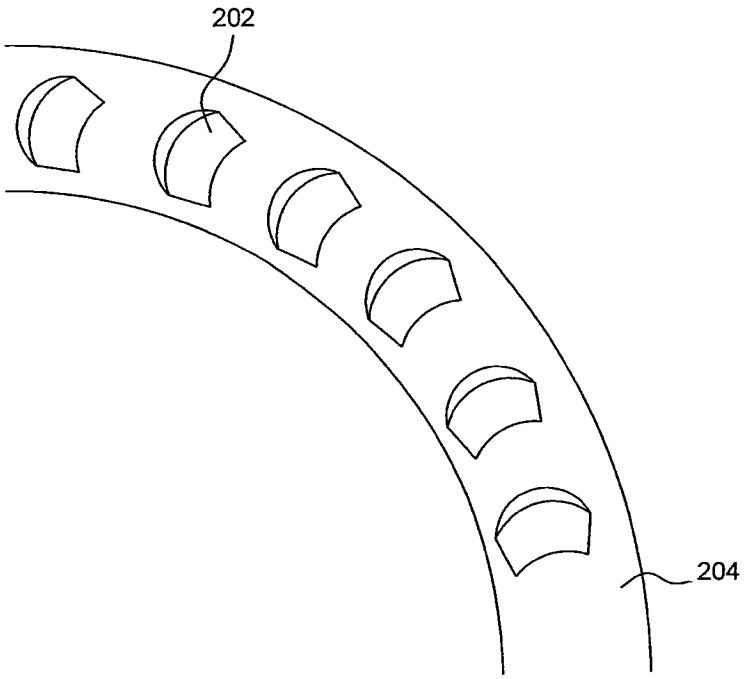
FIG. 4 is a profile view of an end wall having a plurality of diffuser vanes in accordance with some embodiments of the present disclosure.

In embodiments having the plurality of vanes 202 extending axially forward from the end wall 204, front wall 210 comprises a plurality of vane slots (not shown). FIG. 4 provides a partial isometric view of an end wall 204 having a plurality of vanes 202 extending axially forward therefrom. Vane slots formed in the front wall 210 may be of the open or pocketed variety as described above with reference to open vane slots 216 and pocketed vane slots 218 formed in end wall 204.

In embodiments having a variable shroud 104, the disclosed diffuser assembly 200 may be integrated with the shroud 104. In other words, positioning of end wall 204 may account for positioning of the variable shroud 104 to include forward wall 210. Thus an integrated solution may be realized for each set of operating conditions, such that the position of forward wall 210 and end wall 204 may be optimized for all operations of the centrifugal compressor 1.

In operation, motion of the unison ring 222 and/or crank arm 224 effects rotation without axial translation of the outer cam portion 226. Due to threadable engagement of outer cam portion 226 with cam drive 228, the rotation of outer cam portion 226 effects axial translation without rotation of cam shaft 206.

The disclosed diffuser assembly 200 thus allows for variation in the geometry and cross-sectional area of the diffuser passage 208. The position of the end wall 204 may be continuously variable. In some embodiments, the axial motion of end wall 204—and thus the cross-sectional area of the diffuser passage 208—may be adjusted based on operating conditions of the centrifugal compressor. In some embodiments such motion is adjusted based on a predetermined schedule. In other embodiments such motion may be adjusted based on active monitoring of operating conditions, for example by dynamically determining the optimal end wall 204 position based on operating condition measurements such as mechanical position or aerodynamic condition. Adjustment of end wall 204 position results in an increase or decrease in cross sectional area of diffuser passage 208 and thus can be used, among other things, to increase stall margin during low flow operations. In some embodiments, the axial motion of end wall 204 may be adjusted based on the flow rate of the centrifugal compressor.

In some embodiments the position of end wall 204 is variable between at least a first position and a second position. For example, first position may be an axially aft position as shown in FIG. 2A, and second position may be an axially forward position shown in FIG. 2B. In first position, each of the plurality of vanes 202 may extend from the front wall 210 axially aft and into slots of end wall 204. In a second position, each of the plurality of vanes 202 may extend from the front wall 210 axially aft, into, through, or even beyond the slots of end wall 204. An actuator may be used to position end wall 204 between first position and second position.

The present disclosure further includes a method increasing stall margin in a centrifugal compressor. The method begins with defining a diffuser between two axially displaced and opposing disc faces. A plurality of vanes are fixed at the outlet of the compressor, with each vane spanning between the opposing disc faces to interact with fluid within the diffuser to convert dynamic energy of the fluid into static pressure. The diffuser is transitioned between a first arrangement and second arrangement of the opposing faces as a function of flow rate of the compressor. For example, the first arrangement may comprise an axially aft position of one of the opposing disc faces, whereas the second arrangement may comprise an axially forward position of that opposing disc face. The axial displacement between the opposing faces is equal or less than the span of each of the plurality of vanes in the first arrangement, and, in the second arrangement, the axial displacement between the opposing faces is less than in the first arrangement. The step of transitioning between the first arrangement and the second arrangement comprises translating axially one of the opposing faces with respect to the other.

The present disclosure provides numerous advantages over the prior art. Most notably, a continuously variable, axially translating end wall of a diffuser assembly allows for optimization of end wall axial position, and thus optimization of the geometry and cross sectional area of the diffuser flow path. A variable cross sectional area of the diffuser flow path allows for improved stall margin and efficiency, particularly under low flow operating conditions. Similarly, the variable cross section of the diffuser flow path allows for optimization and improved compressor performance across a full range of operating conditions.

The disclosed diffuser assembly is also advantageous as it requires a minimal space cost when compared to previous attempts at varying diffuser output. For example, the disclosed assembly generally requires less radial space that other concepts in the prior art. Further, the disclosed diffuser assembly may be integrated with a variably positioned impeller shroud for coordinated control of forward wall and end wall.

As compared to a variable diffuser having individual vane actuators, the present disclosure provides a more simple solution that greatly reduces the number of moving parts. Additionally, in some embodiments of the present disclosure the structural concerns relating to a leading edge cantilevered design are reduced or eliminated by the use of an end wall translating design.

The present application discloses one or more of the features recited in the appended claims and/or the following features which, alone or in any combination, may comprise patentable subject matter.

According to an aspect of the present disclosure, a variable diffuser for a centrifugal compressor comprises a passage defined between a first disc face and an opposing disc face, and a plurality of vanes within the passage. The first and opposing disc faces extend radially from respective inner edges to respective outer edges. Axial displacement between the respective inner edges defines an inlet of the passage and axial displacement between the respective outer edges defines an outlet of the passage. Each vane spans at least between the first disc face and the opposing disc face, and has a fixed angle with respect to an axis of rotation of the centrifugal compressor. Each vane is translationally fixed to one of the disc faces and extends axially at least into the other of the disc faces. Axial displacement between the first and opposing disc faces is variable.

In some embodiments the first and opposing disc faces are co-axial. In some embodiments the variable diffuser further comprises respective slots in the other of the disc faces through which each respective vane extends. In some embodiments the variable diffuser further comprises a plurality of pocketed vane slots extending axially from the other of the disc faces on the side opposite the one of the disc faces. In some embodiments the plurality of pockets envelopes a portion of each vane which extends through the other of the disc faces.

In some embodiments the first and opposing disc faces are parallel. In some embodiments the variable diffuser further comprises an actuator configured to vary the axial displacement between the first and opposing disc faces.

In some embodiments the actuator comprises a piston connected to one or the other of the disc faces, a cam mechanism, and a crank arm. In some embodiments at least three pistons are distributed circumferentially around one of the other disc faces. In some embodiments the cam mechanism comprises a translationally fixed outer sleeve and a rotationally fixed inner sleeve, and the outer sleeve is rotationally driven by the crank arm and the piston is translationally driven by the inner sleeve. In some embodiments the inner sleeve is rotationally fixed to the piston via an axial key and keyway.

According to another aspect of the present disclosure, a centrifugal compressor comprises an impeller having a high pressure outlet, a scroll, and a variable diffuser between the impeller and the scroll. High pressure gas flows from the high pressure outlet through the variable diffuser to the scroll. The variable diffuser comprises a passage defined between a front disc face and a back disc face, the front and back disc faces extending radially from respective inner edges to respective outer edges; an opening defined between the respective inner edges coupled to the high pressure outlet and another opening defined between the respective outer edges coupled to the scroll; a plurality of vanes within the passage, each vane spanning at least between the front disc face and the back disc face and having a fixed angle with respect to an axis of rotation of the centrifugal compressor; each vane rigidly fixed to front disc face and extend through the passage into the back disc face; the back disc face having a first and second axial position with respect to the front disc face; in the first position, each of the vanes extend into the back disc face and in the second position, each of the vanes extend through and beyond the back disc face; and, an actuator operably connected to the back disc face and translating the back disc face between the first and second positions.

In some embodiments the compressor further comprises a plurality of slots in the back disc face corresponding to the respective plurality of vanes. In some embodiments the compressor further comprises a plurality of pocketed vane slots extending axially from the back disc face on the side opposite the front disc face. In some embodiments the plurality of pockets envelopes a portion of each vane which extends through the back disc face.

In some embodiments the actuator comprises a piston connected to the back disc face, a cam mechanism, and a crank arm. In some embodiments at least three pistons are distributed circumferentially around the back disc face and the cam mechanism comprises a translationally fixed outer sleeve and a rotationally fixed inner sleeve. In some embodiments the outer sleeve is rotationally driven by the crank arm and the piston is translationally driven by the inner sleeve. In some embodiments the inner sleeve is rotationally fixed to the piston via an axial key and keyway.

According to yet another aspect of the present disclosure, a method of changing the operational range of a compressor comprises defining a diffuser between two axially displaced and opposing faces; fixing a plurality of vanes at the outlet of the compressor, each vane spanning between the opposing faces to interact with fluid within the diffuser to convert dynamic energy of the fluid into static pressure; transitioning between a first arrangement and second arrangement of the opposing faces as a function of flow rate of the compressor, wherein the axial displacement between the opposing faces is equal or less than the span of each of the plurality of vanes in the first arrangement, and, in the second arrangement, the axial displacement between the opposing faces is less than in the first arrangement.

In some embodiments the step of transitioning between the first arrangement and the second arrangement comprises translating axially one of the opposing faces with respect to the other.

Although examples are illustrated and described herein, embodiments are nevertheless not limited to the details shown, since various modifications and structural changes may be made therein by those of ordinary skill within the scope and range of equivalents of the claims.

What is claimed is:

1. A variable diffuser for a centrifugal compressor comprising:

a first disc having a first disc face extending radially from a first inner edge to a first outer edge:

a second disc having a second disc face extending radially from a second inner edge to a second outer edge, the second disc positioned opposite and displaced from the first disc such that said second disc face opposes said first disc face, the second disc defining a plurality of pocketed vane slots spaced about a circumference of the second disc face;

a passage defined between the first disc face and the second disc face, wherein axial displacement between the first inner edge and the second inner edge defines an inlet of the passage and axial displacement between the first outer edge and the second outer edge defines an outlet of the passage;

a plurality of vanes within the passage, each vane spanning at least between the first disc face and the second disc face and having a fixed angle with respect to an axis of rotation of the centrifugal compressor, wherein each vane is translationally fixed to the first disc face and extends axially with at least a portion of the vane extending into a respective one of the plurality of pocketed vane slots; and an actuator comprising a cam mechanism and a unison ring, the actuator coupled to one of the first disc and the second disc, wherein axial displacement between the first disc face and the second disc face is varied upon actuation of the actuator, wherein each of the pocketed vane slots defines a pocket unique to a corresponding one of the plurality of vanes.

2. The variable diffuser of claim 1, wherein the first disc face and the second disc face are co-axial.

3. The variable diffuser of claim 2, wherein the first disc face and the second disc face are parallel.

4. The variable diffuser of claim 1, wherein the actuator further comprises a piston coupled between one of the first disc and the second disc and the cam mechanism.

5. The variable diffuser of claim 4, wherein the actuator comprises at least three pistons distributed circumferentially around one of the first disc and the second disc.

6. The variable diffuser of claim 4, wherein the cam mechanism comprises a translationally fixed outer sleeve and a rotationally fixed inner sleeve; and wherein the outer sleeve is rotationally driven by a crank arm and the piston is translationally driven by the inner sleeve.

7. The variable diffuser of claim 6, wherein the inner sleeve is rotationally fixed to the piston via an axial key and keyway.

8. A centrifugal compressor comprising:

an impeller having a high pressure outlet;

a scroll; and a variable diffuser positioned between the impeller and the scroll, wherein high pressure gas flows from the high pressure outlet through the variable diffuser to the scroll, the variable diffuser comprising:

a front disc having a front disc face extending radially from a front inner edge to a front outer edge;

a back disc having a back disc face extending radially from a back inner edge to a back outer edge, the back disc defining a plurality of pocketed vane slots spaced about a circumference of the back disc face:

a passage defined between the front disc face and the back disc face;

an inlet defined between the respective inner edges, the inlet in fluid communication with the high pressure outlet and an outlet defined between the respective outer edges, the outlet in fluid communication with the scroll;

a plurality of vanes within the passage, each vane spanning at least between the front disc face and the back disc face and having a fixed angle with respect to an axis of rotation of the centrifugal compressor each vane rigidly fixed to the front disc face and extending across the passage and having a least a portion of the vane extending into a respective one of the plurality of pocketed vane slots;

the back disc face having a first and second axial position with respect to the front disc face; and an actuator operably connected to the back disc face and translating the back disc face between a first axial position and a second axial position, the actuator comprising: a piston connected to the back disc face, a cam mechanism, and a crank arm, wherein each of the pocketed vane slots defines a pocket unique to a corresponding one of the plurality of vanes.

9. The centrifugal compressor of claim 8, comprising at least three pistons distributed circumferentially around the back disc and wherein the cam mechanism comprises a translationally fixed outer sleeve and a rotationally fixed inner sleeve; wherein the outer sleeve is rotationally driven by the crank arm and the piston is translationally driven by the inner sleeve.

10. The centrifugal compressor of claim 9, wherein the inner sleeve is rotationally fixed to the piston via an axial key and keyway.

11. A method of changing the operational range of a compressor comprising: defining a diffuser between two axially displaced and opposing faces, wherein one of said faces defines a plurality of pocketed vane slots; fixing a plurality of vanes at the outlet of the compressor, each vane spanning from one of said opposing faces and into a respective one of said plurality of pocketed vane slots to interact with fluid within the diffuser to convert dynamic energy of the fluid into static pressure; transitioning between a first arrangement and a second arrangement of the opposing faces as a function of flow rate of the compressor, wherein the axial displacement between the opposing faces is equal to or less than the span of each of the plurality of vanes in the first arrangement, and, in the second arrangement, the axial displacement between the opposing faces is less than in the first arrangement, wherein each of the pocketed vane slots defines a pocket unique to a corresponding one of the plurality of vanes.

12. The method of claim 11, wherein the step of transitioning between the first arrangement and the second arrangement comprises translating axially one of the opposing faces with respect to the other.

* * * * *